United States Patent [19]

Bass

[11] Patent Number: 4,525,880

[45] Date of Patent: Jul. 2, 1985

[54] PORTABLE AUXILIARY TOILET SEAT

[76] Inventor: Joseph Bass, 1400 St. Charles Pl., Pembroke Pines, Fla. 33026

[21] Appl. No.: 521,177

[22] Filed: Aug. 8, 1983

[51] Int. Cl.[3] ..... A47K 13/14

[52] U.S. Cl. ..... 4/244; 4/243; 4/229; 297/221

[58] Field of Search ..... 4/222, 229, 233, 239, 4/242, 243, 244, 245, 246; 297/221, 222

[56] References Cited

U.S. PATENT DOCUMENTS

| | | | |
|---|---|---|---|
| 310,401 | 1/1885 | Fox | 4/239 |
| 396,803 | 1/1889 | Breher | 4/239 |
| 1,156,629 | 10/1915 | Rivera | 4/239 |
| 1,167,201 | 1/1916 | Morén | 4/243 |
| 1,203,454 | 10/1916 | Baird | 4/245 |
| 1,283,533 | 11/1918 | Leighton | 4/245 |
| 1,633,222 | 6/1927 | Noble | 4/239 |
| 2,443,068 | 6/1948 | Dahle | 4/239 |
| 2,742,650 | 4/1956 | Mohun et al. | 4/242 |
| 3,261,030 | 7/1966 | Blem et al. | 4/239 |
| 3,348,243 | 10/1964 | Kelly | 4/245 |
| 3,579,669 | 5/1971 | Loewenstein | 4/245 |

FOREIGN PATENT DOCUMENTS

| | | | |
|---|---|---|---|
| 1127352 | 12/1956 | France | 4/229 |

*Primary Examiner*—Stephen Marcus
*Assistant Examiner*—Linda J. Sholl
*Attorney, Agent, or Firm*—Richad M. Saccocio

[57] ABSTRACT

A portable and foldable toilet seat is disclosed which comprises a thin shell having curved edges which snugly fits over the top of a permanent toilet seat to prevent slippage and includes a stack of disposable liners within said shell. After use, the liner in contact with the permanent toilet seat is peeled away from the stack of liners and appropriately disposed of. The seat may then be folded into a compact quarter oval shape devoid of any contamination from the permanent toilet seat.

11 Claims, 16 Drawing Figures

PORTABLE AUXILIARY TOILET SEAT

BACKGROUND OF THE INVENTION

1. Field of the Invention

This invention relates in general to the field of toilet seats and in particular to portable auxiliary toilet seats to provide sanitary and hygienic seating away from the home and to provide easy portability.

2. Description of the Prior Art

A traveler, as well as others, often encounter unpleasant situations whereby it is absolutely essential to utilize an establishment's toilet facilities or restrooms and the facilities are otherwise than sanitary. To be sure, such experiences are distasteful notwithstanding the possible hazards involved concerning the transmission of communicable diseases. Blind persons are especially adversely affected by such situations because of their inherent inability to be able to even see if a facility is unsanitary let alone to be able to attempt to sanitize such a facility or to prevent from being contaminated by personal contact.

Indeed, even a facility which appears to be sanitary, is not necessarily so. Immediate prior use may render unsanitary, an otherwise sanitary facility. Consequently, the use of any toilet facility away from home is attendant with unavoidable risks.

One widely used prior art attempt to overcome the above-identified problem is the use of paper toilet seat covers which are most often provided in airplanes and other high-class establishments. Typically, such paper covers are available from dispensing apparatus within close proximity of the facility to be used. One paper cover is pulled from the dispenser and applied over the permanent toilet seat. Such covers, however, do not completely solve the above-stated problem. The paper covers do not usually stay in place, they often stick to a person's skin and do not conveniently allow for adjustment of positioning. Consequently, a person often chooses not to utilize the cover especially where the facility "appears" to be sanitary. And, when used, a certain amount of inconvenience and discomfort is still present.

There exists a class of prior art toilet seats which attempt to be compact, foldable, lightweight and convenient to utilize and transport. U.S. Pat. No. 396,803 is one early example of such class of toilet seats. The seat is segmented and joined by appropriate hinges. A clever feature of this inventive seat provides for adjustability of size to accommodate ". . . the size of the opening in the permanent seat or the posterior dimensions of the individual." U.S. Pat. No. 310,401 is is another early example of such class of seats. This example discloses unique hinging apparatus to provide both rigidity and collaspability. U.S. Pat. No. 1,156,629 is still another relatively early example of the prior art class of portable toilet seats which is pertinent to the instant invention. This portable toilet seat also discloses unique hinging apparatus to effectuate the foldability of the seat. U.S. Pat. No. 1,633,222 also discloses a unique hinging method comprising standard hinges in conjunction with tongue and groove connections so as to make the seat very compact when folded and not in use.

In U.S. Pat. No. 2,742,650, the inventor utilizes thin segmented inner panels which are covered on top and bottom by thin plastic sheeting to achieve a very compact, easily foldable, portable toilet seat. The seat folds along lines created by the inner segmented panels. U.S. Pat. No. 2,443,068 discloses another flat covering for a permanent toilet seat. This example of covering or portable toilet seat includes suction cups and a spacer block on the underside thereof to aid in the prevention of lateral slippage when applied to the permanent seat. Finally, U.S. Pat. No. 3,261,030 teaches a unique linking segment so that the individual segments may be collapsed and folded against each other without the necessity of a structural separation of the portions thereof.

All of the prior art portable and foldable toilet seats known to the present inventor suffer from similar deficiencies despite their claimed advantages. Any contamination, dirt, disease, etc., present on the permanent seat is or may be transferred to the underside of the portable toilet seat which then would necessarily contaminate the portable seat. No solution is offered for the removal of such dirt or contamination. In most of the cited examples, the bottom surfaces of the portable seat fold flat against each other so that such contamination is not transferred to the top surface of the seat. Still, it is not desirable for such contamination to be present because of the nature of the same and the very real probability of a person touching the underside surface of the seat or some other object, such as the container for the seat, becoming contaminated, and such other object being touched by the individual thereby indirectly transferring the contamination to an individual.

Most of the prior art portable toilet seats also suffer from being rather bulky and heavy when folded for storage. The example in U.S. Pat. No. 2,742,650, however, probably most successfully directly addresses this problem; but, suffers in other aspects such as transferring of contamination, lateral slippage, etc.

Thus, there still exists a definite need for a portable and foldable toilet seat for use with a permanent toilet seat in restroom facilities away from home, and for such a seat which eliminates the transferring of any contamination from the permanent seat to the portable seat, and for such a seat which is compact, foldable, lightweight, prevents lateral slippage when in use, is comfortable to use, and is convenient to store and transport.

Accordingly, an object of the present invention is to provide a portable and foldable toilet seat which is easily foldable.

Another object of the present invention is to provide a portable and foldable toilet seat which is comfortable to use.

A further objectof the present invention is to provide a portable and foldable toilet seat which prevents forward and lateral slippage when in use.

Still another object of the present invention is to provide a portable and foldable toilet seat which is compact when folded.

A still further object of the present invention is to provide a lightweight portable and foldable toilet seat.

Another object of the present invention is to provide a portable and foldable toilet seat which is easy to store and transport when not in use.

Another object of the present invention is to provide a portable and foldable toilet seat which conveniently allows for sanitizing to eliminate any contamination which might have been transferred from the permanent seat to the portable seat.

SUMMARY OF THE INVENTION

The present invention overcomes the problems of the prior art by providing a foldable and portable toilet seat for use in restrooms away from home. The inventive toilet seat comprises a thin shell having the approximate configuration of the upper surface of a permanent type of toilet seat which is of standard size and shape in the great majority of today's restrooms. Another embodiment of the inventive seat is uniquely adjustable in size so as to fit the more modern elongated permanent toilet seats which are also in wide spread use in today's restrooms. The unique adjustability of the size of the inventive seat can also be used to fit any future differently sized permanent seat. The curved shell of the inventive seat allows the seat to fit over the curved upper surface of any permanent seat so as to effectively prevent forward and aft and lateral slippage. Since the portable seat may be fabricated from a material such as plastic, foldability is provided by utilizing grooves formed in the seat which extend radially outward from the center of the seat and across the width of the seat. In this manner, a one-piece, foldable seat is provided.

The underside of the inventive toilet seat is provided with a stack of thin disposable sheets of paper, one of which may be removed following use and flushed down the toilet. Thus, by disposing of the item which is in immediate contact with the permanent seat, any contamination which was transferred from the permanent seat to the portable seat is conveniently and effectively removed from the portable toilet seat. In a preferred embodiment, the disposable paper liners are made in two "U" shaped stacks which appropriately abut with each other and provide for ease of removal of individual sheets and further provide for convenient and compact foldability of the inventive toilet seat.

Various other objects, advantages and features of the invention will become apparent to those skilled in the art from the following discussion taken in conjunction with the following drawings, in which:

DESCRIPTION OF THE PREFERRED EMBODIMENTS

Figures 1, 3, 4:
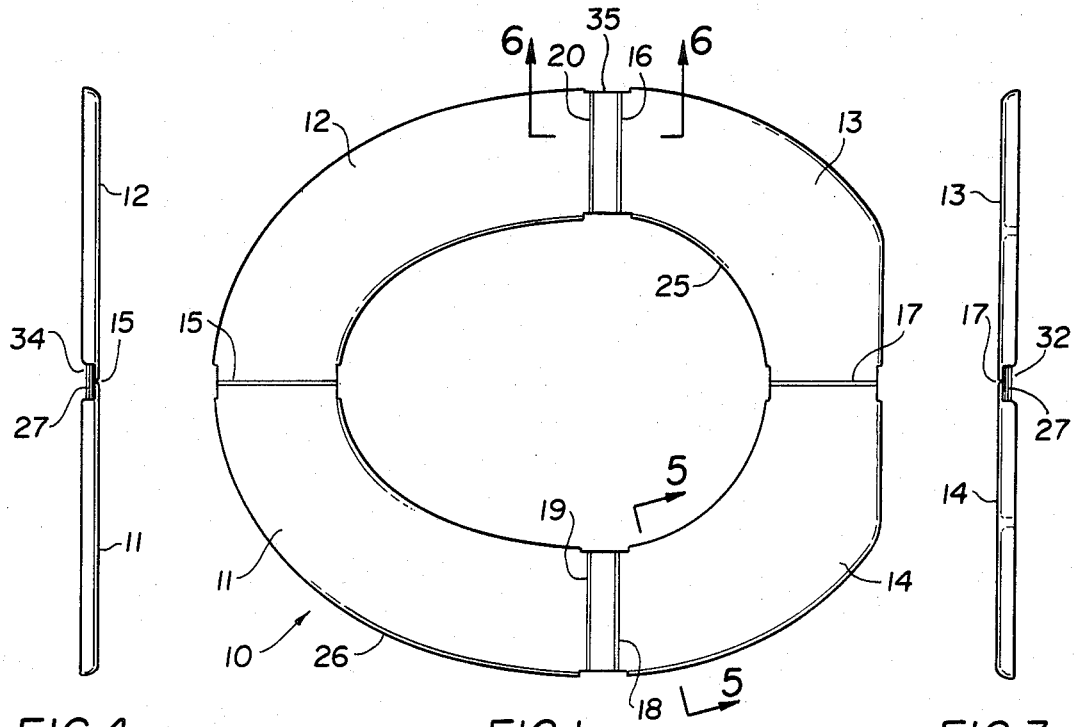
FIG. 1 is a plan view of one embodiment of the inventive portable auxiliary toilet seat.
FIG. 3 is a right side elevation view of the toilet seat of FIG. 1.
FIG. 4 is a left side elevation view of the toilet seat of FIG. 1.
Figure 2:
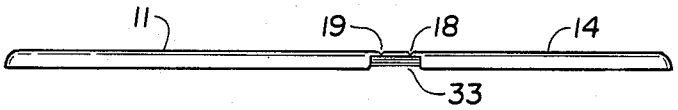
FIG. 2 is a front elevation view of the toilet seat of FIG. 1.

Referring now to the drawings, particularly FIGS. 1 through 6A, which together illustrate various aspects of one embodiment of the inventive toilet seat and which show the general and preferred structural characteristics thereof. It is to be understood that the inventive toilet seat may also be referred to as a seat cover since this is one of its primary functions. The seat which is generally designated by the numeral 10 includes a thin shell 21 having a pair of frontal segments 11 and 12 which may be a mirror image of each other and a pair of rear segments 13 and 14 which may also be a mirror image of each other. Although items 11, 12, 13 and 14 are designated as segments, they may be integral portions of the shell 21 which may be fabricated as a single unit having bend lines 15, 16, 17, 18, 19 and 20 between the portions 11, 12, 13 and 14. For example, shell 21 may be injection molded, vacuum formed, etc., from an appropriate plastic material and bend lines 15, 16, 17, 18, 19 and 20 may comprise vee grooves formed within the thickness and across the width of shell 21. Bend lines 15, 16, 17, 18, 19 and 20 function as hinges, the design of which is well known in the art. Such hinges are extremely reliable and have been known to flex a significant number of times without tearing or breaking. The manner in which seat 10 is foldable for storage and travel will be more fully explained hereinafter.

Seat 10 is intended to fit over a permanent toilet seat so as to assure the user of a completely sanitary seat regardless of where the inventive seat 10 is used. Accordingly, seat 10 is shaped as shown in FIG. 1 to fit over the relatively standard slightly elongated toilet seat in widespread use today. This is not, however, to infer that the inventive seat 10 is restricted to one size.

Figure 5:
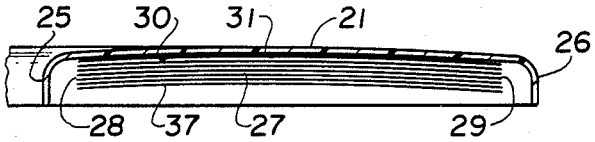
FIG. 5 is a cross-sectional view of the toilet seat of FIG. 1 taken along the line 5—5.

Seat 10 is also intended to fit over a permanent toilet seat such that forward, aft and lateral motion is virtually eliminated between the inventive toilet seat 10 and the permanent toilet seat. Accordingly, the inner 25 and outer 26 edges of shell 21 are downwardly curved as shown in FIG. 5. Shell 21, therefore, is shaped to approximate the upper surface of the permanent toilet seat and when placed thereon will be free from relative motion in any horizontal direction due to the restriction provided by the downwardly curved edges 25 and 26 and the overall crosssectional shape of seat 10.

A pad or stack of paper liners 27 is provided within the underside of shell 21. Paper liners 27 may comprise any number of liners, for example, ten, or even fifty which may be attached to each other in any well-known manner. It is required, however, that each individual liner be capable of being peeled away from the adjacent liner much in the same manner as a sheet of paper may be torn away or peeled off a pad of paper. Hence, the individual liners may be attached to each other by glue along the inner 28 or outer 29 peripheral edges. The uppermost liner 30 is attached in an appropriate manner, such as glue, to the inner surface 31 of shell 21. The glue joint between liner 30 and surface 31 should be more secure than the glue joint between individual liners so that when one liner is torn away from the pad 27 of liners, pad 27 remains attached to shell 21. A new pad 27 may be fitted to shell 21 when the old pad is completely used up. The width of pad 27 is not critical to the operation of the invention; provided, however, edges 28 and 29 should not interfere with the operation of curved edges 25 and 26, which as previously stated, serve to wrap around the curved side edges of the permanent toilet seat in order to limit horizontal movement of seat 10 when in place on a permanent toilet seat. The height or thickness of pad 27 and, therefore, the number of individual liners, likewise, is not critical to the invention, provided, however, pad 27 is not so thick as to lift seat 10 off the permanent seat to negate the wrap-around effect of curved edges 25 and 26. Paper liners of pad 27 may be made from a nonabsorbent and a substantially nonporous paper so that any wetness or other contamination transmitted from the permanent toilet seat is not transmitted to the other liners of pad 27 which are not in immediate contact with the permanent toilet seat.

Figure 6:
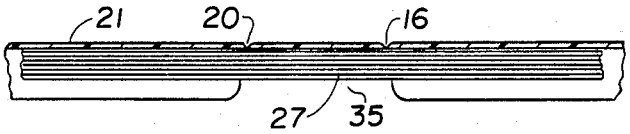
FIG. 6 is a cross-sectional view of the portion of the toilet seat of FIG. 1 taken along the line 6—6.
Figure 6A:
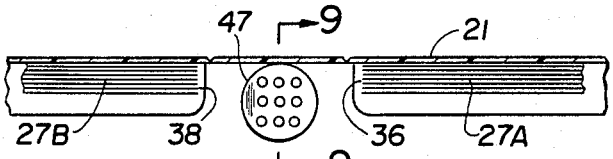
FIG. 6A is a cross-sectional view of another embodiment of the inventive toilet seat of FIG. 1 taken along the same line as FIG. 6.
Figure 10A:
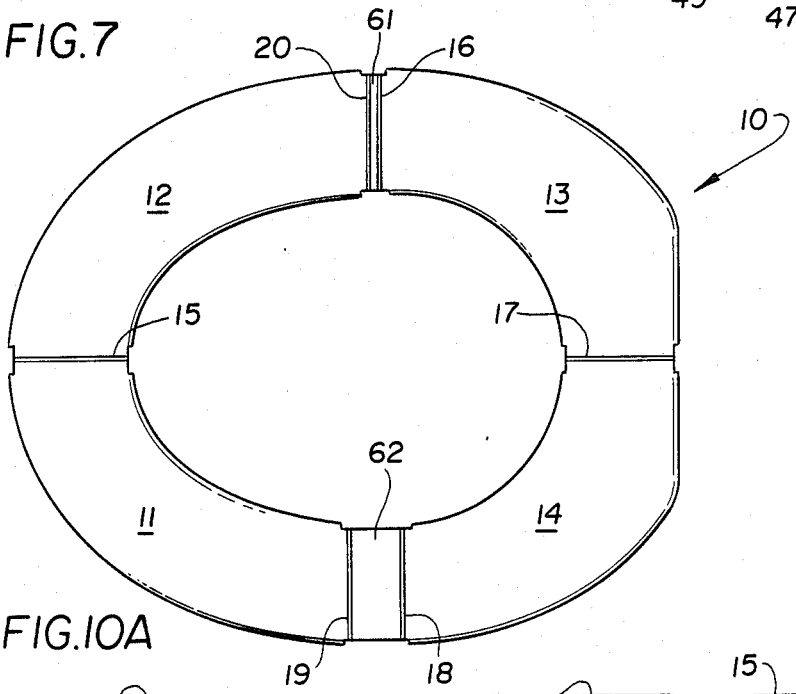
FIG. 10A–10C sequentially illustrate the folding of the inventive toilet seat so as to comprise a compact form for storage and travel; and, FIG. 11 is a plan view of FIG. 10C.
Figure 10B:
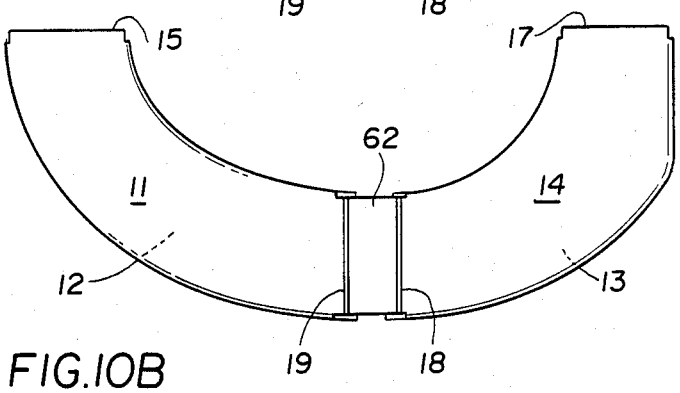

Pad 27 may be made in a one piece oval in conformity with the oval shape of shell 21 of seat 10 or may be made in two "U" or "C" shaped halves. FIG. 6 illustrates the use of the complete oval configuration. FIG. 6A illustrates the use of a two-piece pad 27A and 27B with half 27A being fitted within segments 13 and 14 and half 27B being fitted within segments 11 and 12 of shell 21. The two-piece version of pad 27 which includes voids between bend grooves 16 and 20, and 18 and 19 facilitates folding of seat 10 for storage and transport. Cutouts 32, 33, 34 and 35 in outer curved edge 26 and inner curved edge 25 of shell 21 likewise facilitates folding and storage by providing clearance when seat 10 is folded as shown in FIG. 10.

Figure 7:
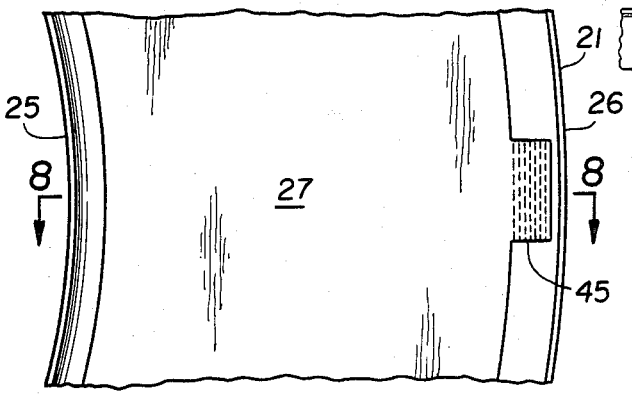
FIG. 7 is an underside partial view of the right side portion of another embodiment of the toilet seat of FIG. 1.
Figure 8:
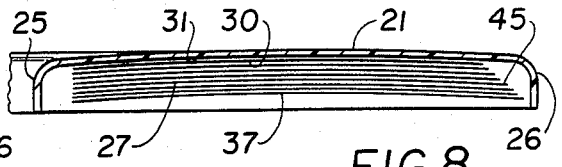
FIG. 8 is a cross-sectional view of the embodiment of FIG. 7 taken along the line 8—8.
Figure 9:
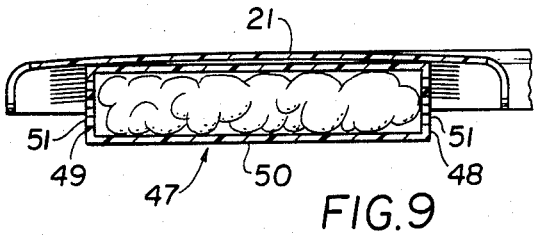
FIG. 9 is a cross-sectional view of the inventive toilet seat of FIG. 1 taken along the line 9—9 of FIG. 6A.

FIGS. 7 and 8 depict tabs 45 on individual liners of pad 27 extending outward from pad 27. Tabs 45 facilitate peeling or tearing off individual liner sheets from pad 27 after each use of seat 10. The tab 45 on each individual liner sheet is progressively longer than the preceding tab as the liner sheets progress from the liner 30 closest to surface 31 of shell 21 to the outermost liner 37 as more clearly seen in FIG. 8. In this manner, the person using seat 10 may more easily grasp the single tab 45 of the liner which was most recently in contact with the permanent toilet seat and peel off the contaminated liner. If the two-piece pad 27A and 27B is used, a similar set of tabs 45 may be used with each half of pad 27.

Figure 6B:
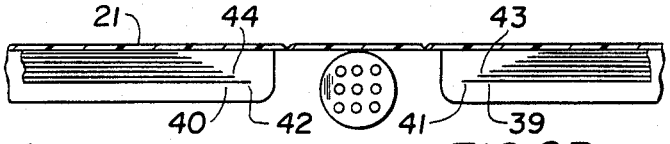
FIG. 6B is a cross-sectional view of still another embodiment of the inventive toilet seat of FIG. 1 taken along the same line as FIG. 6.

FIG. 6B illustrates another embodiment of two-piece pad 27. Instead of the square or flush edges 36 and 38 of the two-piece pad 27 embodiment of FIG. 6A, the edges 39 and 40 of each end of individual liners of pad 27A and 27B, respectively, are progressively longer than the corresponding liner next closer to shell 21. Thus, the liner furthermost away from shell 21 which is the liner in contact with the permanent toilet seat has ends 41 and 42 which slightly extend beyond ends 43 and 44 of the liner immediately closer to shell 21. The extended ends of the outermost liner allow for easy grasping of the used or contaminated liner and subsequent peeling off of the contaminated liner.

A vial 47 having soft flexible ends 48 and 49 and a soft flexible cylindrical body 50 may be attached to the underside surface 31 of shell 21 in any appropriate manner such as glue, welding, etc., as shown in the embodiments depicted in FIGS. 6A, 6B, 6C and 9. Vial 47 may contain a material such as cotton which is saturated with a sanitizing deodorant and/or other like pleasant smelling and/or sanitizing solution. Ends 48 and 49 are provided with a plurality of openings 51 through said ends. When seat 10 is placed on a permanent toilet seat and is thereafter exposed to the weight of the user, vial 47 is compressed, as allowed by the flexibility of the body 50 and ends 48 and 49, the air therein is expelled causing said deodorizer and/or perfume to be discharged into the atmosphere thereby creating a sanitizing and/or a pleasant smelling effect. It is to be noted that vial 47 is not necessarily limited to the shape depicted in the drawings. For example, an oval shape may be used. A number of other alternatives to the specific embodiment shown will be apparent to one skilled in the art. Similarly, the invention is not to be limited to the particular method described to dispense the sanitizing deodorant and/or perfume. The size and location of vial 47 should not interfere with the nonslip, wrap-around fitting of seat 10 to a permanent toilet seat. If the size of vial 47 is larger than the overall thickness of seat 10, the compressibility of vial 47 will allow for such nonslip features. A vial 47 having a smaller cross-sectional shape, as compared to shell 21, allows for immediate retention of the nonslip feature but may not allow for sufficient compressibility to provide sufficient dispensing of the sanitizing deodorant.

Figure 6C:
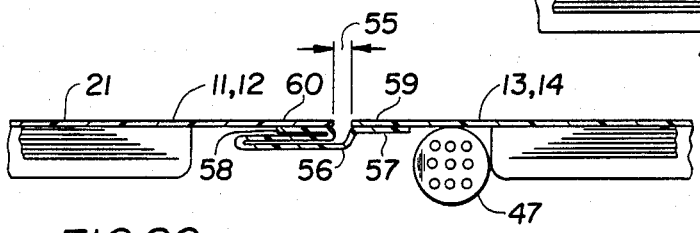
FIG. 6C is a cross-sectional view of an even further embodiment of the inventive toilet seat of FIG. 1 taken along the same line as FIG. 6.

FIG. 6C illustrates an embodiment which permits the inventive seat 10 to be expanded to increase the size of opening 55 and to increase the size of shell 21 to allow seat 10 to fit a larger or elongated permanent toilet seat. In this embodiment, segments 13 and 14 are separate from segments 11 and 12 but joined by a flexible expansion piece 56. Expansion piece 56 may comprise a substantially rectangular, thin strip of plastic which is readily foldable or foldable by use of vee grooves (as previously described). The ends 57 and 58 of expansion piece 56 are respectively connected to ends 59 and 60 of segments 13 and 14, and 11 and 12 such as by gluing or welding. When it is desired to expand seat 10, segments 13 and 14 are simply pulled away from segments 11 and 12 allowing expansion piece 56 to expand to its unfolded length. Conversely, when it is desired to utilize a smaller seat 10, expansion piece 56 is folded upon itself as shown in FIG. 6C. Vial 47, if used, may be relocated as shown.

Figure 10C:
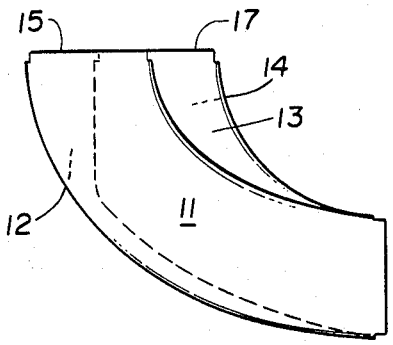
Figure 11:
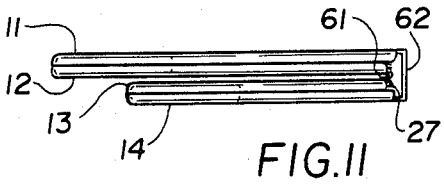

When it is desired to store seat 10, as when it is not in use, seat 10 is folded into the shape shown in FIG. 10C. This may be accomplished by first folding seat 10 along fold lines 15 and 7 so as to result in the shape shown in FIG. 10B. Seat 10 may then be folded along lines 18 and 19 and 16 and 20. Section 62 between lines 18 and 19, and section 61 between lines 16 and 20 allow seat 10 to be folded with negligible springback into the shape shown in FIG. 10C. Section 62 may be wider than section 61 in order for section 61 to be folded within or internal to section 62 as shown in FIG. 11 without interference from pad 27 and the downward sloped edges 25 and 26 of shell 21. It is to be noted that the underside of folded seat 10 does not contact the outer surface of seat 10. Folded seat 10 may then be placed in a conveniently sized and shaped carrying case for transport and future use.

When it is desired to use seat 10, it is removed from its carrying case, if one is used. Seat 10 is then unfolded to the shape shown in FIG. 1 or to a larger size as permitted by expansion joint 56 and fitted onto permanent a toilet seat. Upon completion of use, the liner which was in immediate contact with the permanent toilet seat is peeled off the pad of liners and appropriately disposed of. The seat 10 is then folded for future use.

While the invention has been described, disclosed, illustrated and shown in certain terms or certain embodiments or modifications which is has assumed in practice, the scope of the invention is not intended to be nor should it be deemed to be limited thereby and such other modifications or embodiments as may be suggested by the teachings herein are particularly reserved especially as they fall within the breadth and scope of the claims here appended.

I claim:

1. A portable toilet seat adapted to fit over a permanent toilet seat comprising, a shell made from a thin semirigid material having a substantially oval shape with a substantially oval opening therethrough, said shell having inner and outer edges extending curvingly downward from the top surface thereof such that said portable toilet seat substantially conforms to the top surface of said permanent toilet seat when fitted thereon, one or more thin disposable liners having a substantialy oval shape fitted within said shell, said one or more liners being removable from said shell following use thereof, and a least four hinges connected to said shell with each hinge being spaced apart from each adjacent hinge by approximately ninety degrees whereby said sheel is foldable into a first half oval shape with the inner surfaces of each half oval being in contact with each other and is foldable into a second one-quarter oval shape with the outer surfaces of each quarter oval being in contact with each other.

2. The portable toilet seat of claim 1, wherein said shell is comprised of two half oval shaped halves each abutting end thereof being joined together by a thin expansion joint whereby when extended the size of said inner oval may be increased to accommodate different sizes of said permanent toilet seat.

3. The portable toilet seat of claim 1, wherein said folding means comprises six hinges, one at zero degrees, two at ninety degrees, one at one hundred and eighty degrees and two at two hundred and seventy degrees, with a first distance between said two hinges at ninety degrees and a second distance between said two hinges at two hundred and seventy degrees.

4. The portable toilet seat of claim 3, wherein said second distance is larger than said first distance and wherein said first and third hinges are used to fold said seat into said first half oval shape and said second and fourth pairs of hinges are used to fold said seat into said one-quarter oval shape and wherein said hinge pair having the second larger distance therebetween is external of said hinge pair having said first distance therebetween.

5. The portable toilet seat of claim 3, wherein said shell is made from a thin plastic material and said hinges comprise vee grooves extending radially across the surface of said shell.

6. The portable toilet seat of claim 1, wherein said one or more thin disposable liners comprises a plurality of liners having an oval shape substantially coinciding with the shape of said shell.

7. The portable toilet seat of claim 6, wherein each of said one or more thin disposable liners include tabs with each outermost liner having a tab which progressively extends beyond the tab of each adjacent innermost liner.

8. The portable toilet seat of claim 1, wherein said one or more thin disposable liners comprise a first and second plurality of liners, each plurality of liners comprising individual liners stacked on top of each other and each plurality of liners having a half oval shape which butt together at the ends thereof to form said complete oval shape, with a space between said abutting ends located between said hinges for folding said seat into said one-quarter oval shape.

9. The portable toilet seat of claim 8 wherein the space between the abutting ends of each pair of liners progressively increases from the outermost pair of liners to the pair of liners innermost of said shell.

10. The portable toilet set of claim 1, including means for dispensing a sanitizing deodorant attached to said shell.

11. The portable toilet seat of claim 10, wherein said sanitizing deodorant dispensing means comprises a flexible container filled with said sanitizing deodorant which is activated by being compressed between said shell and said permanent toilet seat.

* * * * *